US005467603A

United States Patent [19]

Lehman et al.

[11] Patent Number: 5,467,603

[45] Date of Patent: Nov. 21, 1995

[54] HIGH-PRESSURE GAS SUPPLY INSTALLATION

[75] Inventors: Jean-Yves Lehman, Maisons Alfort; Charles Mirigay, Saint Maur des Fossés, both of France

[73] Assignee: L'Air Liquide, Societe Anonyme Pour L'Etude Et L'Exploitation Des Procedes Georges Claude, Paris, France

[21] Appl. No.: 272,384

[22] Filed: Jul. 6, 1994

[30] Foreign Application Priority Data

Jul. 8, 1993 [FR] France ..... 93 08394

[51] Int. Cl.[6] ..... F17C 7/04

[52] U.S. Cl. ..... 62/50.2; 62/47.1; 62/48.1; 62/48.3; 62/50.1

[58] Field of Search ..... 62/47.1, 48.1, 62/48.3, 50.1, 50.3, 50.4, 50.2

[56] References Cited

U.S. PATENT DOCUMENTS

| | | | |
|---|---|---|---|
| 2,344,765 | 3/1944 | Dana et al. | 62/48.1 |
| 3,091,096 | 5/1963 | Rendos et al. | 62/50.2 |
| 3,096,625 | 7/1963 | Legatski | 62/47.1 |
| 3,216,209 | 11/1965 | Krigsman | 62/50.4 |
| 3,263,433 | 8/1966 | Fitt | 62/50.2 |
| 3,273,349 | 9/1966 | Litvin et al. | 62/50.2 |
| 3,304,739 | 2/1967 | Erath | 62/50.4 X |
| 3,318,307 | 5/1967 | Nicastro | 62/50.2 X |
| 3,371,497 | 3/1968 | Singleton | 62/47.1 X |
| 3,650,290 | 3/1972 | Moen et al. | 137/339 |
| 4,646,525 | 3/1987 | Delacour et al. | 62/47.1 |
| 4,961,325 | 10/1990 | Halvorson et al. | 62/48.1 |

FOREIGN PATENT DOCUMENTS

| | | | |
|---|---|---|---|
| 2406782 | 6/1979 | France | 62/47.1 |

*Primary Examiner*—Christopher Kilner
*Attorney, Agent, or Firm*—Young & Thompson

[57] ABSTRACT

The installation comprises an insulated storage tank (1) containing the gas in at least partially liquid form at a high pressure, a line (2) comprising a vaporizer (3) for supplying gas to a user station (A), a first cold-holding circuit (4), comprising a valve (5) and a first exchanger (6) in heat-exchange contact with the fluid in the first tank (1), and a pressure-holding line (8) comprising a second exchanger (9) and a valve (10). The system is particularly useful as a backup installation for a main gas-production source (30).

6 Claims, 1 Drawing Sheet

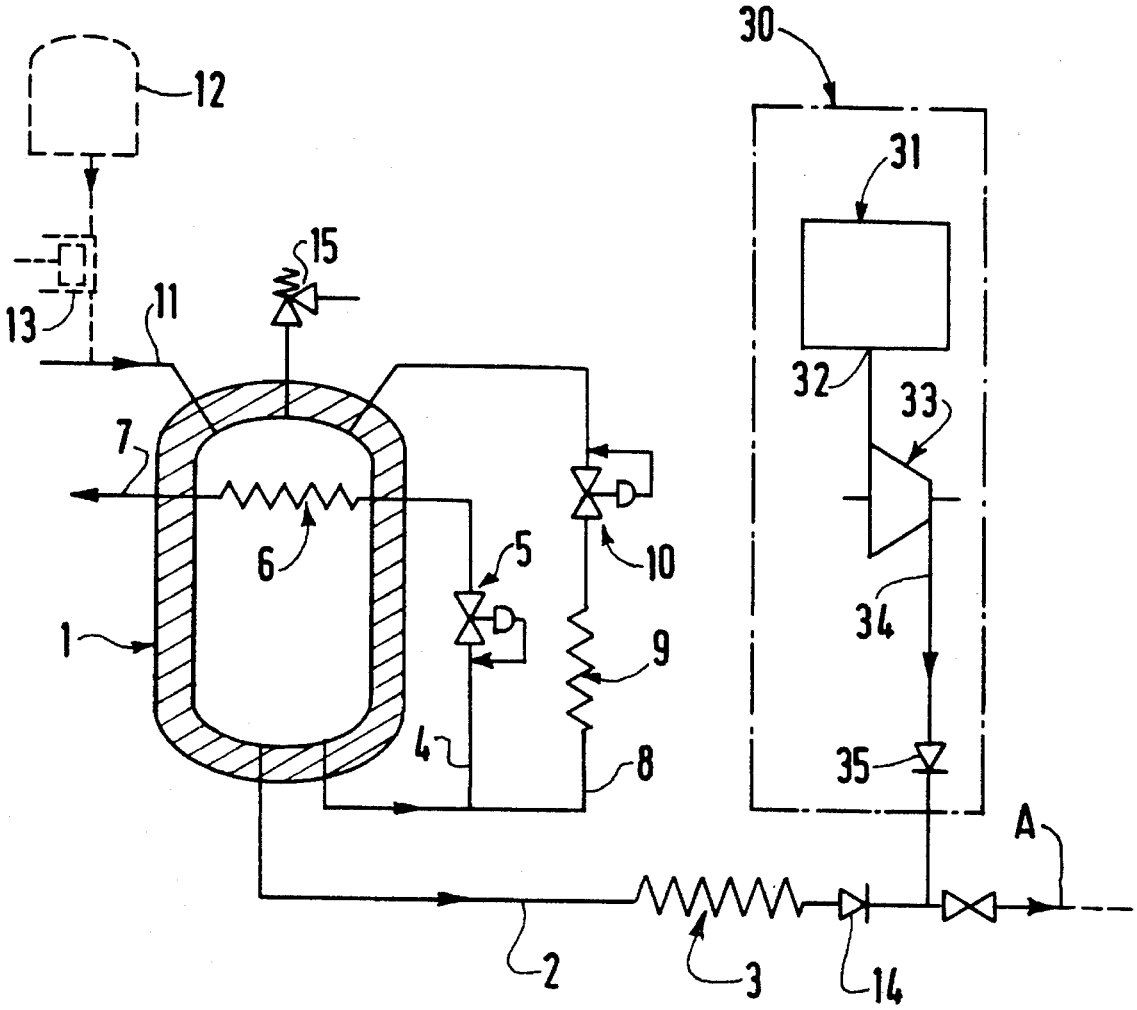
30
12
31
15
13
11
32
33
7
6
5
10
1
9
34
4
8
35
A
2
3
14

HIGH-PRESSURE GAS SUPPLY INSTALLATION

FIELD OF THE INVENTION

The present invention relates to an installation or supplying a gas under high pressure to at least one user station, of the type comprising an insulated tank for storing the gas in at least partially liquid form, having an upper part and a lower part, and at least one supply line comprising an evaporator extending between the lower part of the first tank and the user station.

BACKGROUND OF THE INVENTION

In numerous industrial fields, the current trend is to require sources of gas at increasingly high pressures. For industries consuming large quantities of gas, this gas is generally brought in the gaseous phase to the high pressure by a compressor, the gas being produced in situ by a unit for producing the gas, generally by cryogenic separation. For smaller gas consumptions, this gas is generally stored in liquid form at low pressure, vaporized and pressurized.

Even with high gas pressures in the meaning of the present invention, that is to say greater than $10\times10^5$ Pa and possibly greater than $100\times10^5$ Pa, these technologies do not pose major problems in continuous operation. It is, however, necessary to provide, in case of malfunction of the main installation, a backup installation capable of taking over, for at least a limited period of time, the production of the gas. At the pressure levels in question, backup installations do, however, pose problems, especially as regards their capacity to provide the gas immediately at the required pressure. In this respect, the setting-up of a nominal regime with a pump or a compressor is a serious handicap.

SUMMARY OF THE INVENTION

The object of the present invention is therefore to provide a compact gas supply installation of particularly simple and efficient design, with "static" operation, requiring no compression component or auxiliary energy and allowing instantaneous supply, optionally on demand, of a gas under high pressure, especially at a supercritical pressure, in particular, but not exclusively, as backup for a main installation for supplying this gas under high pressure.

For this purpose, according to one feature of the invention, the installation includes a first fluid circuit starting from the lower part of the tank, comprising, in series, a pressure controlled valve and a first exchanger in heat-exchange contact with the fluid in the first tank, and keeping the latter cold.

According to other features of the invention, the installation further includes:

- a second fluid circuit extending outside the tank between the lower and upper parts of the latter, comprising, in series, a second exchanger and a second pressure controlled valve, and keeping the fluid in the first tank at a storage pressure substantially equal to the supply pressure.

With the arrangements according to the invention, the gas is kept, typically in a supercritical state, at a pressure $P_s$ substantially at least equal to the user pressure $P_u$ and can thus be supplied instantaneously at said pressure to the user station.

BRIEF DESCRIPTION OF THE DRAWING

Other features and advantages of the present invention will emerge from the following description of embodiments, which are given by way of illustration but without any limitation, made with reference to the attached drawing, in which:

The single FIGURE is a schematic view of a high-pressure gas supply installation according to the invention which can be used as backup for a main gas production unit.

DETAILED DESCRIPTION OF THE INVENTION

In the embodiment represented in the FIGURE, the installation for supplying a gas, typically oxygen or nitrogen, under high pressure to at least one user station A comprises an internally or externally thermally insulated tank 1, from the lower part of which a supply line 2 leaves and extends as far as the user station A, passing through a heater or an evaporator 3. According to one aspect of the invention, a first fluid circuit 4 leaves, independently from the line 2, from the lower part of the tank 1, which first fluid circuit includes an inlet and closure valve 5 controlled by the pressure prevailing in the tank 1 and passing through a heat exchanger 6 in heat-exchange contact with the fluid in the tank and arranged, as in the embodiment represented, inside the tank 1, in thermal contact with the fluid in the tank, optionally through the wall of the casing. Beyond the exchanger 6, the circuit 4 is extended, outside the tank 1, to an outlet 7 for connection to the atmosphere or to a circuit for using the gas under a low or medium pressure, or for recycling to a main production unit, as will be seen further on.

A second circuit 8 also leaves, independently of the line 2, from the lower part of the tank 1, which second circuit joins up with the upper part of the tank 1 and comprises, in series, a heat exchanger 9, for example of the atmospheric type and a pressure-control valve 10 sensitive to the pressure prevailing in the tank 1. The latter further includes a filling pipe 11 which can be connected to a high-pressure gas source or to an assembly consisting of at least one tank 12 of said liquified gas, under low pressure, and a high-pressure pump 13 with low delivery rate. A non-return valve 14 is provided in the supply .line 2, downstream of the vaporizer 3. The tank 1 is provided, at its upper part, with a surge valve 15.

It will be understood that, in the arrangement which has just been described, the first circuit 4, using the unexpanded stored cold fluid, makes it possible to recover the cold energy from the vaporized fluid in the tank 1 via the heat inlets in order to cool the fluid in the tank and thus to keep it at the lower temperature required and therefore at the desired pressure. In addition, the second circuit 8 keeps the fluid in the tank 1 at the high pressure required. It will be understood that, with the fluid permanently located in the tank 1, at a high storage pressure $P_s$ equal to or slightly less than the nominal pressure $P_u$ required for the user station A, gas at substantially the same pressure can be sent instantaneously to the user station A.

As mentioned above, the autonomous installation which has just been described finds a particularly advantageous application as a backup installation for a large-capacity gas production source 30, for example a cryogenic unit 31 which produces, at one of its outlets 32, the working gas under a medium pressure which is brought, by a compressor 33, to the user pressure $P_u$ and transported, by a pipe 34 provided with a non-return valve 35 and communicating with the downstream end of the supply line 2, to the user station A.

In normal operation of the source 30, all of the gas is supplied to the user station A by this source 30, the valve 14 being therefore closed. The installation including the tank 1 is in standby configuration. In the event of malfunction of the source 30, especially of its electrical power source, the pressure drop in the pipe 34 leads to automatic opening of the valve 14, the installation then taking over instantaneously to supply the user station A with the gas at the pressure $P_s$.

The working gas is typically nitrogen or oxygen, in which case the production unit 30 is a cryogenic air distillation unit. In the case of a unit 30, having a production capacity of 1000 tonnes per day of oxygen supplied to the user station A, at a pressure of the order of $80\times10^5$ Pa, in order to provide backup autonomy for 20 minutes, at the nominal production rate, the installation according to the invention must have a useful quantity stored per $m^3$ of storage capacity under said pressure of approximately 820 $kg/m^3$ and at a temperature of approximately −150° C., i.e. a tank 1 volume of approximately 20 $m^3$.

Although the invention has been described with particular embodiments, it is not limited thereto but the person skilled in the art may, on the contrary, make thereto such modifications and variations as occur to him.

We claim:

1. An installation for supplying a gas under high pressure to at least one user station, comprising an insulated tank for storing the gas in at least partially liquid form at a pressure greater than $10\times10^5$ Pa, having an upper part and a lower part, at least one supply line comprising an evaporator and extending between the lower part of the tank and the user station, a first fluid circuit extending between the lower part of the tank and an outer circuit portion comprising, serially arranged, an ON/OFF valve, and a first heat exchanger in heat exchange relationship with the fluid within the tank to thereby keep the tank cold.

2. The installation as claimed in claim 1, further including a second fluid circuit extending outside the tank between the lower and upper parts of the tank, comprising, in series, a second exchanger and a pressure controlled valve to thereby keep the fluid in the first tank at a storage pressure substantially equal to the supply pressure.

3. The installation as claimed in 1, wherein the storage pressure in the tank is greater than the critical pressure of the gas.

4. The installation as claimed in 1, wherein the gas is oxygen nitrogen.

5. The installation as claimed in 1, wherein the gas is oxygen.

6. The installation as claimed in claim 1, associated with a unit for producing said gas by separation of a gaseous mixture containing said gas and comprising at least one pipe for supplying said gas under said high pressure in fluid flow communication with the supply line of the installation.

* * * * *